US006487949B1

(12) United States Patent
Dharia

(10) Patent No.: US 6,487,949 B1
(45) Date of Patent: Dec. 3, 2002

(54) JUST-IN-TIME BULK RUBBER BALE PROCESSOR

(76) Inventor: Amitkumar N. Dharia, P.O. Box 2466, Coppell, TX (US) 75019

( * ) Notice: Subject to any disclaimer, the term of this patent is extended or adjusted under 35 U.S.C. 154(b) by 0 days.

(21) Appl. No.: 09/561,672

(22) Filed: May 1, 2000

(51) Int. Cl.[7] ..... B26D 5/20; B26D 7/00

(52) U.S. Cl. ..... 83/213; 83/152; 83/157; 83/171; 83/408; 83/418; 83/437.2; 83/452; 83/467.1; 83/471.1; 83/471.2; 83/487; 83/639.1; 83/663; 83/697; 83/923; 83/277; 83/214; 83/255; 83/268

(58) Field of Search ..... 83/16, 24, 28, 83/52, 100, 147, 150, 152, 157, 171, 404, 407, 408, 418, 437.8, 794, 453, 467.1, 471.1, 471.2, 485, 487, 639.1, 663, 270, 697, 279, 909, 923, 922, 932, 614, 202, 213, 452, 277, 454, 214, 455, 255, 268; 241/605; 269/21

(56) References Cited

U.S. PATENT DOCUMENTS

| | | | | | |
|---|---|---|---|---|---|
| 2,282,546 | A | * | 5/1942 | Schwimmer | 83/80 |
| 2,889,878 | A | * | 6/1959 | White et al. | 83/165 |
| 3,333,494 | A | * | 8/1967 | Smith | 83/861 |
| 3,385,336 | A | * | 5/1968 | Barnard | 83/52 |
| 3,990,336 | A | * | 11/1976 | Soodalter | 83/404.2 |
| 4,040,318 | A | * | 8/1977 | Makeev et al. | 83/71 |
| 4,043,231 | A | * | 8/1977 | Friedberg | 83/408 |
| 4,136,749 | A | * | 1/1979 | Di Rosa | 177/25 |
| 4,280,575 | A | | 7/1981 | di Rosa | 177/123 |
| 4,909,139 | A | * | 3/1990 | Montano et al. | 83/404 |
| 4,929,086 | A | | 5/1990 | Geyer | 366/76 |
| 4,991,477 | A | * | 2/1991 | Butt et al. | 83/35 |
| 5,410,954 | A | * | 5/1995 | Wygal et al. | 99/537 |

* cited by examiner

*Primary Examiner*—Boyer D. Ashley
(74) *Attorney, Agent, or Firm*—Dennis T. Griggs

(57) ABSTRACT

A bale processor for cutting or dicing a bale or slab of unvulcanized rubber produces small cubes or blocks of a predetermined size and uniform shape for continuous feeding at a predetermined rate into a mixing machine or blender. A bale or slab of feedstock rubber is advanced incrementally along a slider platform and a segment is sliced from the leading end of the bale. After separation, the segment falls onto a receiving panel from which it is transferred by a vacuum pick-up head to a vacuum hold-down table. Multiple slices are then formed through the segment along the X-axis by circular cutting blades of an X-axis cutter head, thereby forming elongated segment strips. Next, multiple slices are formed through the segment strips in the Y-direction by a Y-axis cutter head which includes circular cutter blades that are extendable and retractable along the Y-axis. The bulk slab or bale is thus reduced to multiple cubes of predetermined length, height and width dimensions as established by the dimension of the initial segment slice and by the spacing of the circular cutting blades of the X-cutter head and the Y-cutter head, respectively.

13 Claims, 7 Drawing Sheets

JUST-IN-TIME BULK RUBBER BALE PROCESSOR

BACKGROUND OF THE INVENTION

The present invention relates in general to the processing of bulk unvulcanized rubber material, and in particular to a bale processor for cutting or dicing a bale or slab of unvulcanized elastomer such as ethylene propylene diene terpolymer (EPDM) or styrene butadiene (SBR).

Bulk synthetic rubber such as unvulcanized elastomer is normally supplied in a dense rubber bale or slab, typically 24"×18"×8" size and 24 kg weight, often wrapped in a thin protective plastic film. Due to its high bulk density and compact size, the bulk rubber bale or slab is the most economical and safe form for shipping, storage and handling.

The term rubber as used herein refers to a natural rubber or polymer resin having in its unvulcanized state properties of deformation upon stress and recovery upon release of the stress. A rubber can be further defined as having a glass transition temperature of below 20° C. Most rubbers have a raw polymer Mooney value of from about 20 to about 125 measured at 100° C. (212° F.) after 4 minutes using a large rotor, i.e. a ML-4 reading, and have an elongation at break of from about 100 percent to about 1000 percent or more.

Examples of unvulcanized bulk rubbers that can be processed by the present invention include natural rubber, polyvisoprene rubber, polybutadiene rubber, cis-polybutadiene rubber, polychloroprene rubber, polysulfide rubbers, polypentenamer rubbers, polyacrylated rubbers, poly(butadieneacrylonitrile) rubbers, poly(isopreneacrylonitrile) rubbers, poly(styrenebutadiene) rubbers, poly(isoprene-styrene rubbers) poly(ethylene-propylene-diene) rubbers, and the like. The term rubber as used in this invention also includes blends of two or more of the elastomers. The rubbers may be blended with resins or fillers prior to forming the bale or slab.

In recent years, the use of thermoplastic elastomers (TPE), which are melt-mixed blends of thermoplastic resins such as polypropylene and synthetic elastomer, is increasing rapidly. Blends of thermoplastic resin, elastomers, plasticizers or softeners, fillers and stabilizers offer significant advantages over thermosetting elastomers, including 100% recyclability, ready-to-use pelletized form, no need for curing, lower density, ease of processing, lower cost per unit, and colorability.

Thermoplastic elastomers are produced using either an internal batch mixer or continuous mixers. In recent years, many producers of TPEs have used continuous mixers because of their ability to provide uniform product quality, short residence time and versatility. Various ingredients are metered directly through small input openings in the continuous machine using automatic feeding devices. For consistent feeding and trouble-free operation, all ingredients must be small in size, uniform in shape and non-agglomerating in nature. Since a rubber bale is very large, it must be reduced to pieces or fragments that are size-compatible with automatic feeding equipment and other ingredients. Even in a batch mixer, where whole dense bales can be used, smaller size feedstock reduces cycle time and hence reduces overall productivity and quality of product. In making rubber-based adhesives, smaller size rubber feedstock enhances the rate of solvent diffusion.

Various devices including guillotine cutters, granulators and shredders use rotary knives, shears or saw blades for comminuting and reducing the size of scrap plastic and rubber. For example, U.S. Pat. No. 4,280,575 discloses a machine for cutting and metering a slab of unvulcanized rubber, which utilizes a continuous blade band sawing machine for cutting slices of rubber. U.S. Pat. No. 4,929,086 discloses a shredding machine which uses a rotary screw blade equipped with both radial and longitudinal knives for cutting shreds of polymer from a feedstock bale.

Such machinery is not suitable for dense bales of rubber because (1) unvulcanized rubber tends to flow under the influence of shear; (2) such machines are large in size, require special installation, use large amounts of energy, create loud noise, break down frequently, and require time-consuming cleaning; and, (3) the resulting product is either very large in size (e.g. as produced by guillotine cutters) or consists of a mixture of fine powder, fluff and large irregularly shaped chunks that are not suitable for continuous feeding applications. Moreover, the reduced material tends to stick and agglomerate, and has limited shelf life. Such machines are intended for large scale operation in production environment only and not suitable for small scale operations (i.e. lab scale devices).

Some producers of thermoplastic elastomers use a two-step method in which elastomer bale material is mixed with thermoplastic resin using an internal mixer, and reduce the size of the mixed material into pellets using an extruder-pelletizer or dices using a roll mill-dicer. Besides being a costlier process, there are other limitations to that conventional process: (1) the rubber material is subjected to two heat and shear steps which affects its durability; (2) many high molecular weight elastomers are highly oil extended which requires long mixing times; (3) are applicable only where the formulation consists of a large amount of thermoplastic resin; (4) the resulting pellets or dice must be dusted with a partitioning agent to keep them from re-agglomerating during handling; and, (5) such pelletized materials have short shelf life and tend to agglomerate when stored under hot and humid conditions.

Some producers of elastomers provide rubber bales in form which can easily be broken into small popcorn-like crumbs. Even though very beneficial, such feed stock also has significant limitations: (1) crumbs with irregular surfaces tend to have very low bulk density and do not feed well using conventional feeders; (2) the crumbs tend to interlock in the feed hopper causing feed-blocking; (3) the crumbs do not pack efficiently and thus require large storage space; (4) only those elastomers with medium molecular weights, high comonomer content and no oil are available in the form of dense bales; and (5) adding oil during mixing reduces shear, prolongs mixing time, and thus reduces production rates.

Most recently, some producers using new catalyst technology are supplying selected grades in free-flowing granular or large pellet forms. Currently, only a small range of some selected elastomers are available in the free-flowing granular shape, and none with any oil.

From the above discussion, it is clear that the baled elastomer must be reduced in size, preferably to portions of uniform size and shape to accommodate the needs of continuous mixing processes. The conventional reduction methods discussed above have one or more of the following limitations:

(1) high cost of size reduction equipment;
(2) irregular shape and size of resulting product not suitable for continuous feeding;
(3) lower bulk density of reduced product requires larger storage area;
(4) limited shelf life;

(5) requires unwanted partitioning agents to extend shelf life; and, (6) size reduction method poses limitations on choice of elastomer and mixing method.

BRIEF SUMMARY OF THE INVENTION

Small cubes or blocks of a predetermined size and uniform shape are reduced from a bale or slab of unvulcanized rubber for continuous feeding at a controlled rate into a mixing machine or blender along with compounding chemicals during the mixing and extrusion of synthetic rubber and elastomeric products. A bale or slab of unvulcanized rubber is advanced along a loading platform on the input end of a processor console. The bale is fed incrementally into a first cutter assembly at a first cutter station where a segment of predetermined width is sliced from the leading end of the bale. The segment is transferred by a vacuum pick-up head to a second cutter station where it is secured for further reduction on a vacuum hold-down table.

After the segment is immobilized on the hold-down table, it is then sliced into elongated, parallel strips by an X-axis cutter head which includes an array of rotary cutter blades that are extendable and retractable across the segment in parallel with the X-axis. While the reduction strips are firmly held in place on the vacuum hold-down table, they are diced by a Y-axis cutter head which includes an array of rotary cutter blades that are extendable and retractable across the elongated strips in parallel with the Y-axis.

The slab segment is thus reduced to multiple cubes of predetermined length, height and width dimensions as established by the initial segment slice dimension and by the spacing of the roller cutting blades in the X-cutter head and the Y-cutter head, respectively. The bale is advanced incrementally at the speed demanded by the blending process, so that feed stock cubes are continuously transferred at a controlled rate to the feed throat of a mixing or shaping machine such as an extruder or internal mixer.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

DETAILED DESCRIPTION OF THE INVENTION

Figure 1:
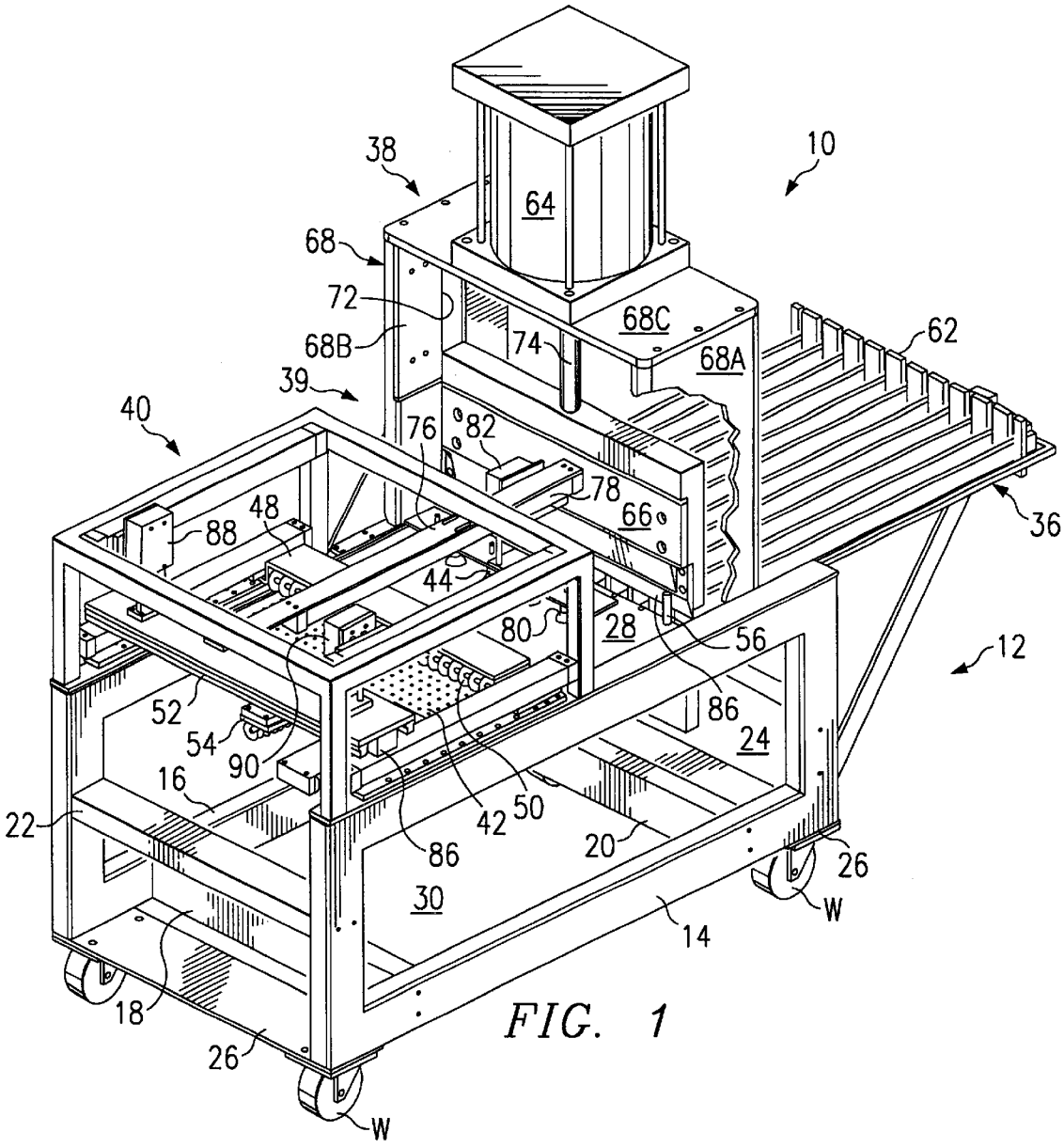
FIG. 1 is a right side perspective view of a bale processor constructed according to the present invention.

Preferred embodiments of the invention will now be described with reference to various examples of how the invention can best be made and used. Like reference numerals are used throughout the description and several views of the drawing to indicate like or corresponding parts.

The bale processor of the present invention is designed to continuously cut dense bales of unvulcanized rubber/synthetic elastomer into small size, regular and uniformly shaped cubes.

Figure 2:
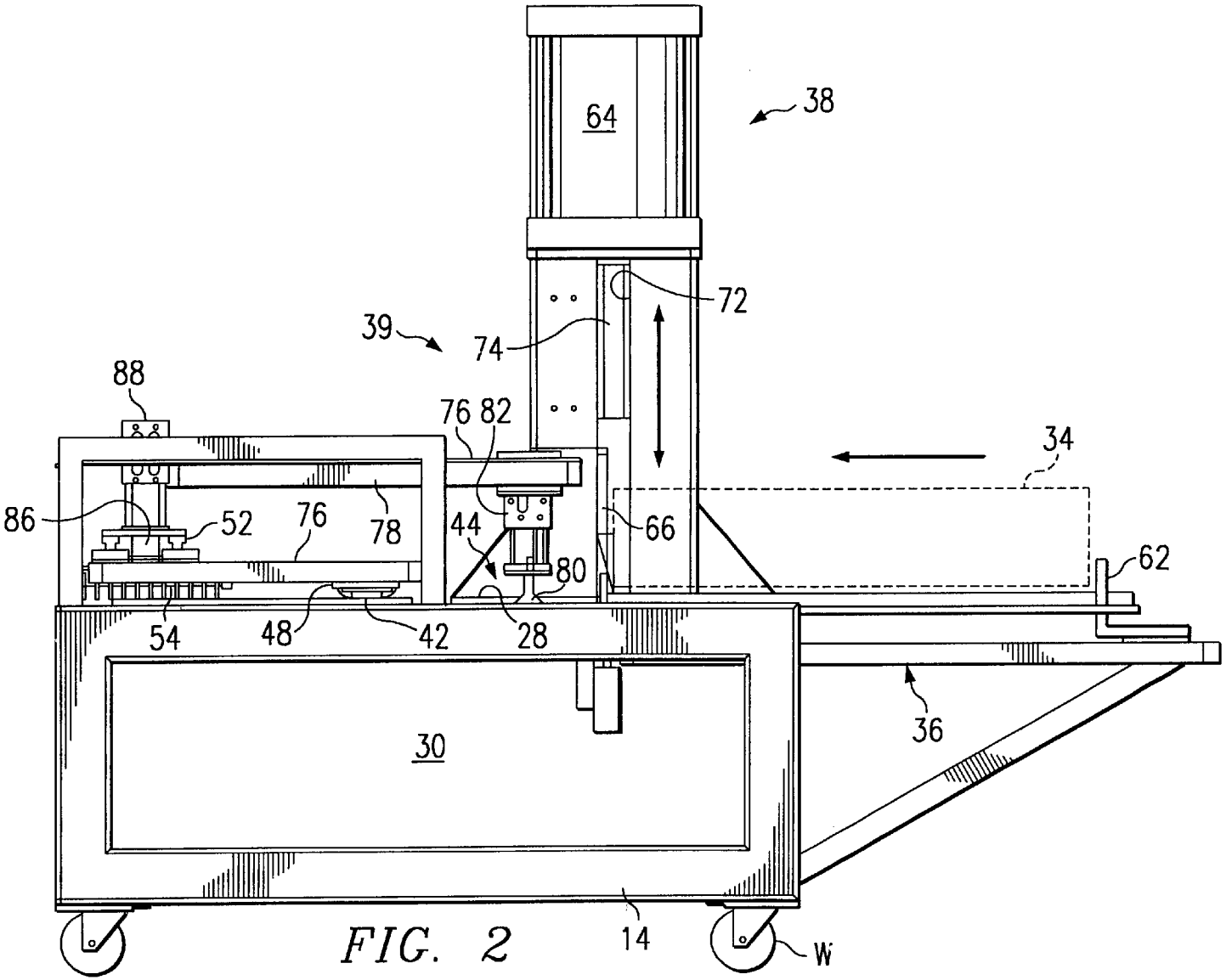
FIG. 2 is a top plan view thereof.
Figure 3:
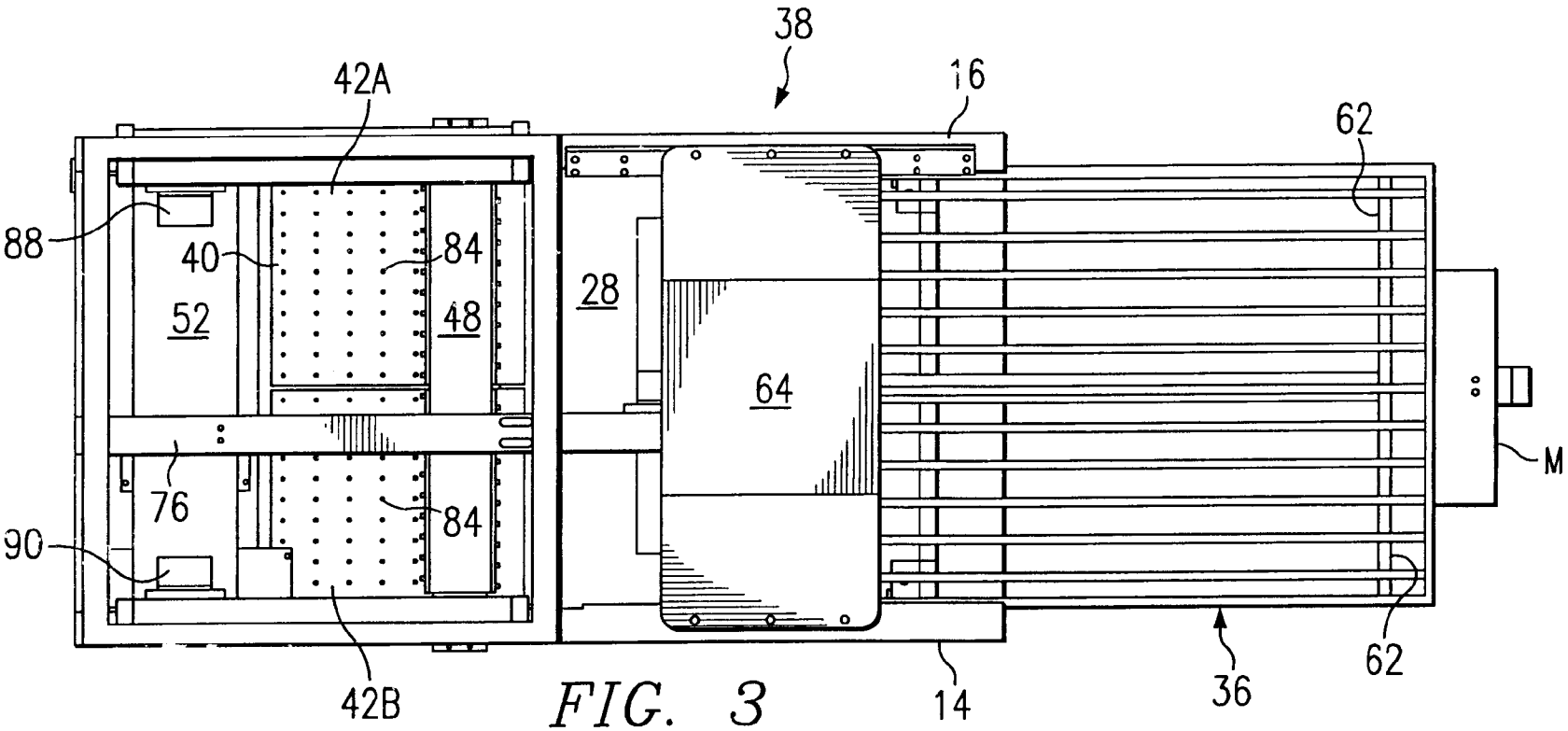
FIG. 3 is a right side elevational view thereof.

Referring now to FIGS. 1, 2 and 3, in particular, a bulk rubber processing unit constructed according to the present invention is generally designated by the numeral 10. The bale processing unit 10 includes a console 12 which is advantageously made up of rectangular perimeter side members 14, 16 made of narrow gauge steel or aluminum angle stock, for example. The console 12 is stabilized by crossbars 18, 20, 22 and 24. Brace plates 26 are suitably secured to the perimeter members, such as by mechanical fasteners or welding, at the delivery end and loading end of the console.

The end braces 26 are adapted to journal an axle for corner support wheels. Conventional caster wheels W are secured to the perimeter frame members at the respective corners of the console at which the end braces 26 are attached.

The bale processing assembly 10 is portable so that it can be positioned in line with a conveyor belt or a weigh bin for transferring reduced rubber product at a controlled rate to the feed throat of a mixing or shaping machine such as an extruder or internal mixer. For this purpose, the console 12 is equipped with lockable wheels W which permit rolling movement of the bale processing unit 10 from one workstation to another. After the portable bale processing unit has been positioned correctly, its wheels W are locked by depressing wheel locking arms, and the bale processing equipment carried on the console 12 is made ready by an attendant.

Figure 6:
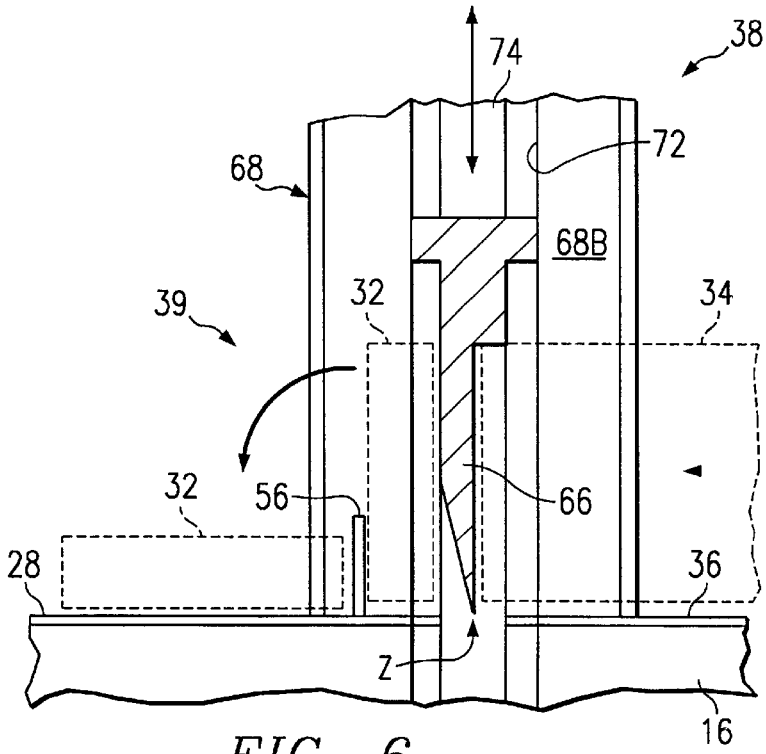
FIG. 6 is a sectional view, partially broken away, of the cutting blade assembly shown in FIG. 1.
Figure 7:
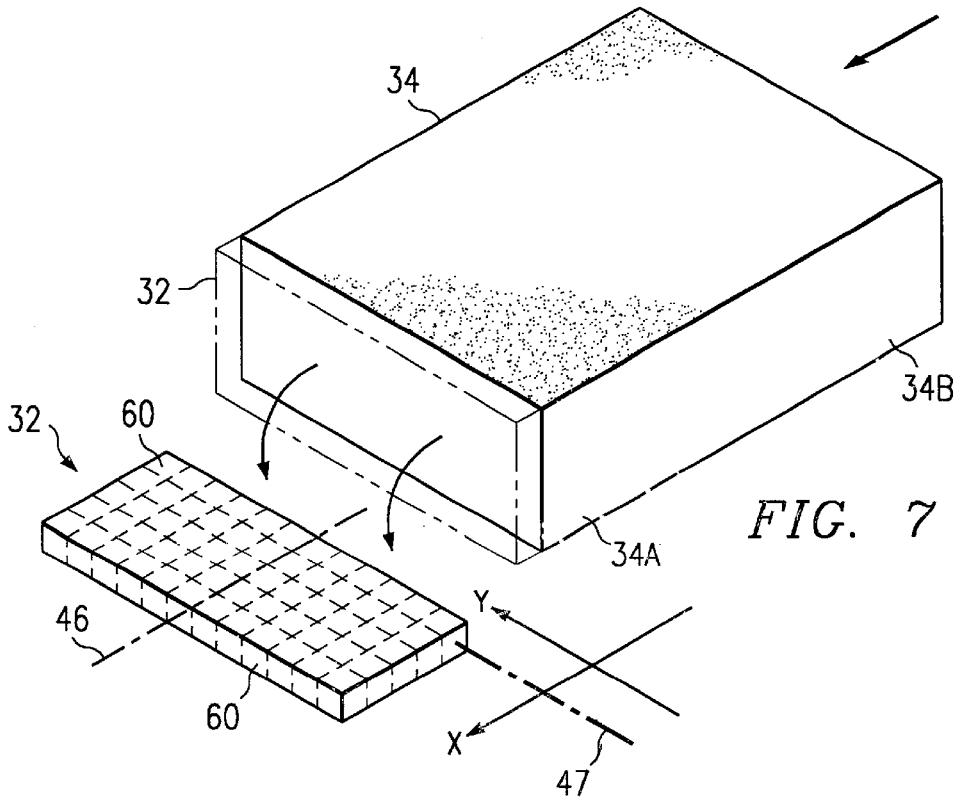
FIG. 7 is a simplified, perspective view of a rubber bale or slab from which a segment has been sliced during the cutting step of the invention.

The console 12 provides stable support for the bale processing steps in which a segment portion 32 on the leading end 34A of a rubber bale 34 is sliced through a vertical plane as shown in FIG. 6 and then parallel slices are formed through the segment in the X-direction and Y-direction as indicated in FIG. 7.

The console 12 also supports an operational deck 28 which is elevated above a drop space 30. The console 12 further supports a bale loading platform 36 which extends from the rear end of the console 12.

Figure 9:
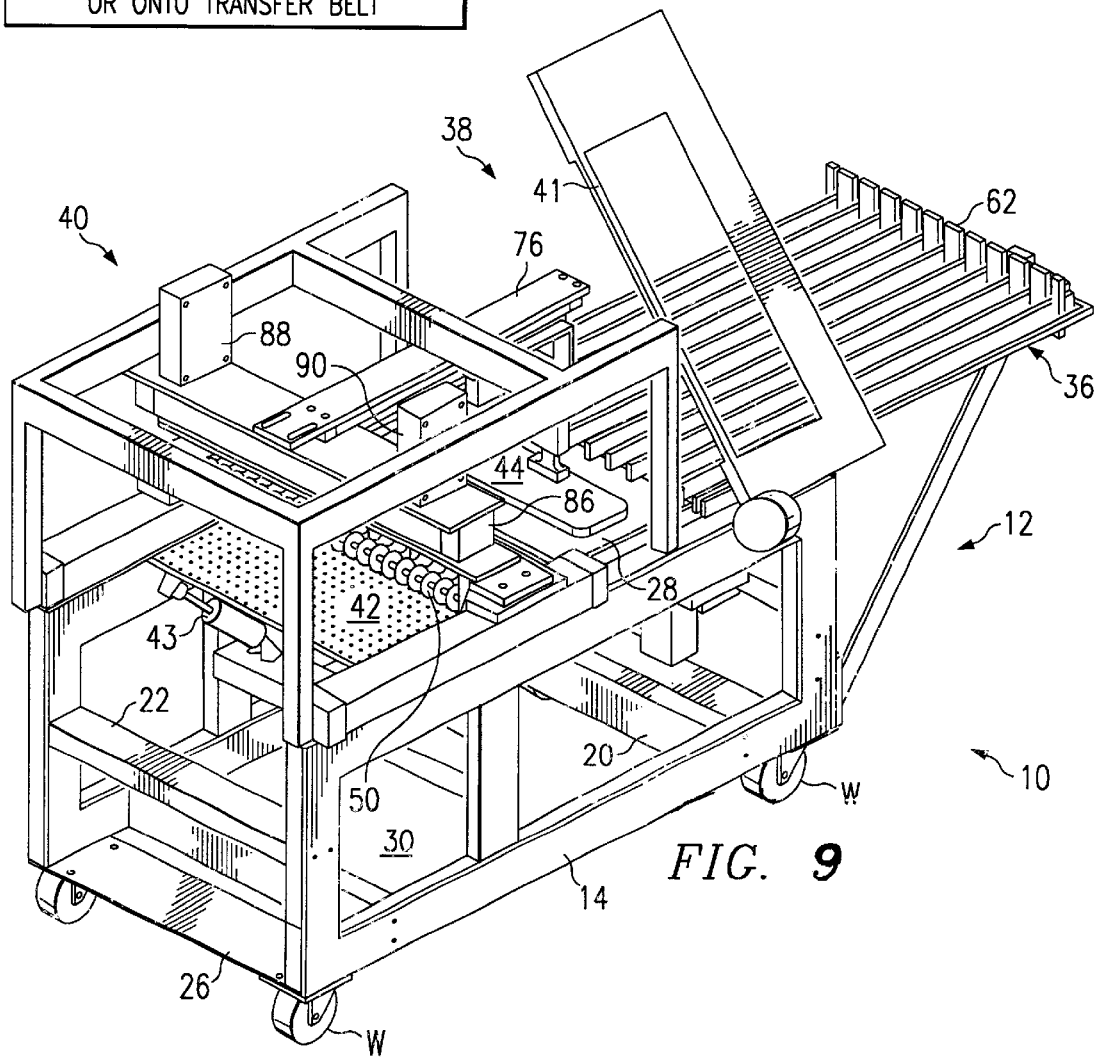

The console 12 further supports a cutter 38 in the form of a guillotine blade assembly 39 which is mounted on top of the console 12 at the delivery end of the bale loading platform 36. In an alternative embodiment, the cutter assembly 38 includes a continuous blade band saw cutter 41, as shown in FIG. 9.

An X-Y cutter assembly 40 is mounted on the delivery end of the console 12, directly overlying the drop zone 30. A vacuum hold down table 42 is mounted beneath the X-Y cutter assembly, directly over the drop zone 30 and aligned in coplanar relation with the surface of the operational deck 28. The vacuum hold down platform 42 preferably consists of two sections, 42A, 42B that are independently coupled by hinges to the console and are selectively extended and retracted by a double acting linear actuator 43 for discharging reduced segment product into the drop zone 30. Optionally, the hold down platform 42 consists of a single platform section, as shown in FIG. 9, which is coupled by a hinge for pivotal swinging movement from a horizontal support position to an inclined discharge position.

Figure 8:
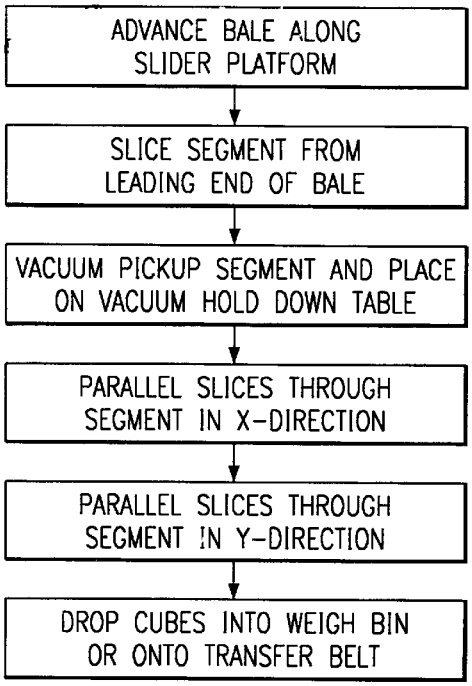
FIG. 8 is a flow chart which illustrates the principal steps of the invention; and, FIG. 9 is a right side perspective view of a bale processor which includes a continuous band saw cutter.

Referring to the flow chart of FIG. 8, the bale 34 is advanced along the loading platform 36, and a segment 32 is sliced from the leading end 34A of the bale. After separation from the bale, the segment 32 falls flat onto the operational deck 28, where it is picked up by a vacuum pick-up head 44 and transferred to the vacuum hold-down table 42. Multiple slices are then formed along parallel lines 46 through the segment 32 along the X-axis by the X-cutter head 48 which includes a gang of circular cutting blades 50 that are movable along the X-axis. Next, multiple slices are formed along parallel lines 47 through the segment 34 along the Y-axis by a Y-axis cutter head 52 which includes circular cutter blades 54. According to this arrangement, the slab segment 32 is reduced to multiple cubes 60 of predetermined length, height, and width dimensions as established by the spacing of the circular cutter blades 50, 54 of the X-cutter head 48 and Y-cutter head 52, respectively.

The foregoing steps are performed by components which are supported on the console 12 as follows. The bale loading platform 36 includes a movable fence 62 for advancing the bale along the longitudinal axis of the load platform toward the guillotine assembly 38. The guillotine assembly 39 includes a fixed stop fence 56 for properly indexing the leading end 34A of the bale as it is advanced into a cutting zone Z. The guillotine assembly 39 includes a pneumatic or hydraulic ram 64 that drives a shear blade 66. The ram and blade are mounted on a support frame composed of side support panels 68A, 68B and a top support panel 68C. The shear blade 66 is guided for vertical extension and retraction within a pair of guide channels 70, 72 along the side support frame panels 68A, 68B, respectively. The guillotine blade 66 is extended and retracted along the guide channels by a piston rod 74 which is actuated as the hydraulic ram is switched.

When segment slices smaller than ⅜ inch are desired, the segments are preferably cut by the continuous band saw cutter of FIG. 9.

As each segment 32 is sliced from the leading end of the bale 34, they fall or are pushed over onto the receiving panel 28 below the vacuum pick-up head 44. The vacuum pick-up head is extended and retracted along an overhead rail 76 by an air cylinder 78. The vacuum pick-up head includes multiple suction cups 80 which are extendable into engagement with the slab segment upon extension of an air stroke cylinder 82. After the segment has been engaged, the air cylinder 82 is retracted and the vacuum pick-up head along with the segment 32 is transferred along the overhead rail to a position overlying the vacuum hold down table 42.

After the sliced segment 32 has been placed onto the vacuum hold down table 42, the segment is immobilized and held in place on the table by the pressure differential exerted as ambient air is pulled through the inlet openings 84.

The vacuum hold down table 42 is supported in coplanar relation with the receiving panel 28 and includes multiple air inlet openings 84 for drawing in ambient air. The vacuum hold down table is coupled to an air suction pump (not shown).

The segment 32 is further reduced by forming multiple slices through the body of the segment in the X-direction, as indicated in FIG. 7. This cutting step is performed by the circular cutting blades 50 of the X-cutter head 48. The circular cutting blades can be fixed or rotary. The X-cutter head is movably mounted for extension and retraction along the overhead rail 76 in parallel with the X-axis, as shown in FIG. 1 and FIG. 7. The X-cutter head is driven by the double-acting air cylinder 78. The elevation of the circular cutting blades on the X-cutter head relative to the hold down table 42 is set to perform clean slicing action through the segment, without scoring the vacuum hold down table.

Figure 4:
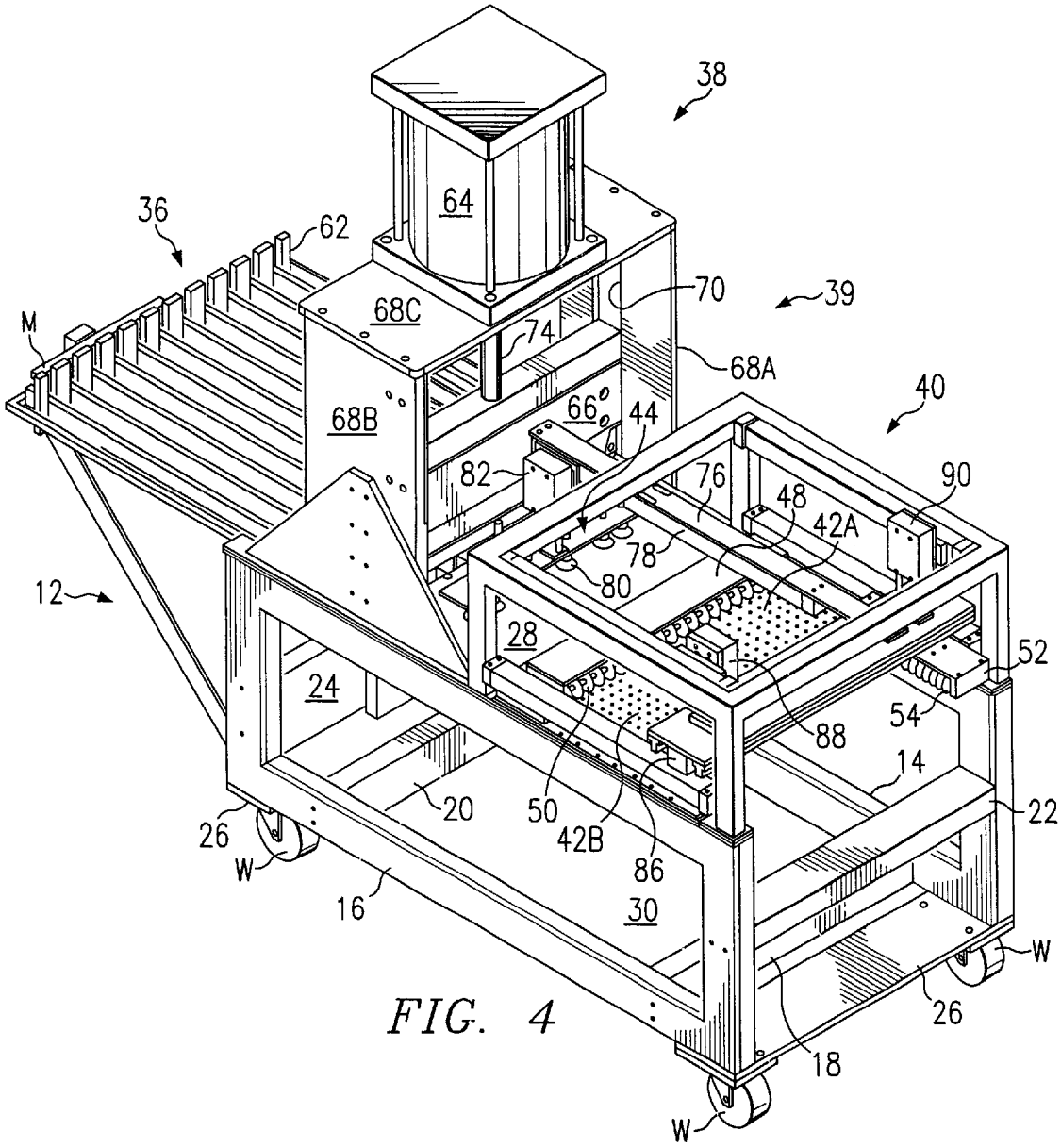
FIG. 4 is a left side perspective view thereof.
Figure 5:
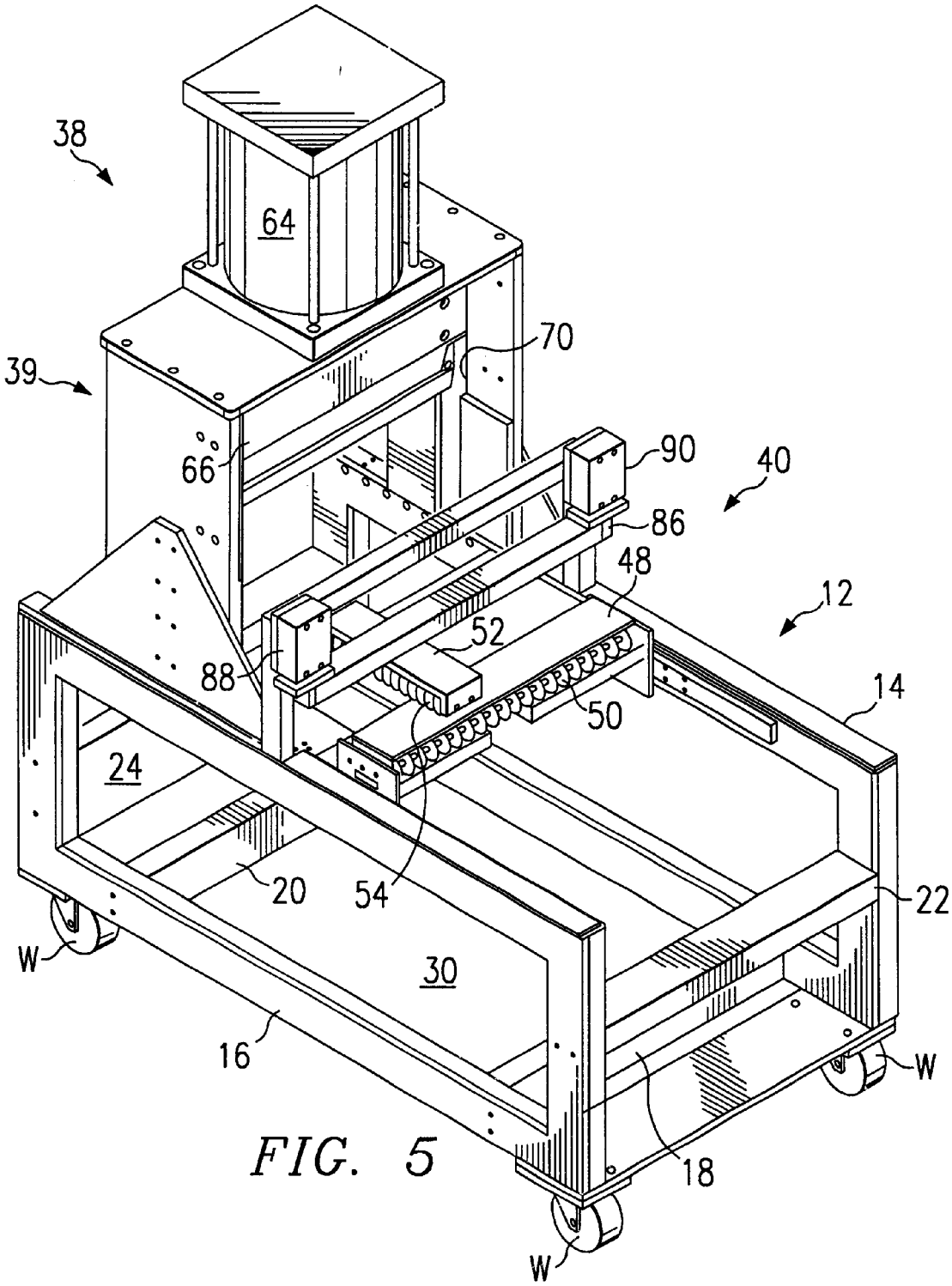
FIG. 5 is a left side perspective view thereof with the frame partially assembled.

Referring again to FIG. 1 and FIG. 7, the multiple slices in the Y-direction are performed by the Y-cutter head 52. The Y-cutter head is mounted on a double-acting rodless air cylinder 86 for extension and retraction along the Y-axis. The double-acting air cylinder 86 is supported on opposite ends by double-acting air cylinders 88 and 90, respectively. According to this arrangement, the Y-cutter head is retracted out of the way while the X-cutter head is performing its slicing operation. After the X-cutting operation has been completed, the X-cutter head is extended all the way forward toward the front end of the console (FIG. 4), to permit the Y-cutter head 54 to perform its operation without interference. The Y-cutter head 54 is extended downwardly into engagement with the segment and then either extended or retracted along the Y-axis, and the Y-slicing operation is then completed.

A bale or slab 34 of dense rubber is manually or automatically loaded on the platform 36, and is pushed by the fence 62 which is moved manually or by a stepping motor M, and screw drive such that bale's leading edge 34A advances incrementally into the cutting zone Z by a distance ½ inch (for a guillotine cutter) or ⅛ inch (for a band saw cutter) equivalent to desired height of the cube 60. The hydraulic ram 64 drives the guillotine blade 66, thus cutting thin segments 32 from the rubber bale. A special attachment to the cutter assembly separates each segment 32 from the blade and allows it to fall flat on the receiver platform 28.

The segment 32 is lifted by the air suction cups 80 and is transferred to the perforated hold down platform 42 in X-direction by a 20" stroke rodless air cylinder to a position under the bank of rotary cutting wheels 50. The distance between the cutting wheels is adjustable from ½ inch to ⅜ inch and is equivalent to the desired width of a reduced cube 60. The segment 32 is immobilized and held down by vacuum applied through holes in the platform. This set of cutting wheels cut the segment into strips.

The circular cutting wheels are separated by a ¼ inch solid washer and ¼ inch spring. By tightening the nuts, the distance between cutting wheels can be adjusted ½ inch to ⅜ inch. The springs also allow the circular cutting blades to adjust under mechanical force or heat without undue damage.

Optionally, the shaft of the circular blade 66 is cooled with recirculating water to keep the cutting blade from overheating. Moreover, a noise barrier blanket is placed around the guillotine to reduce "hissing noise" as pressurized air is released when the pneumatic cylinders are actuated.

A dispenser (not shown) sprays talc or similar fine-sized powder to keep the reduced cubes from sticking to each other when they are to be stored for later use.

When the second set of circular cutting blades reaches the opposite side in Y-direction, a switch triggers and opens the perforated hold-down platform sections 42A, 42B of the hold-down table. This allows the elastomer cubes 60 to fall through the drop zone 30 into a weigh bin or conveyor belt from which the cubes are mechanically transferred at controlled rate to the feed throat of a mixing or shaping machine such as an extruder or internal mixer.

The bale processor of the present invention provides a simple but unique method for solving the bale reduction problem. The just-in-time bale processor not only overcomes most of the limitations of conventional reduction equipment but also offers significant performance advantages. Because its small size and simplicity, the bale processor does not require large capital investment and is adaptable to large as well as small lines with an output rate of 10 kg/hour or more. The output rate can be increased by using multiple guillotine or saw blades. The bale processor is small in size and does not require any major installment and can easily be moved from station-to-station and placed in-line. It accommodates normally available dense bales of any molecular weight, with and without oil extension, irrespective of type of elastomer, and does not pose a noise problem. It produces small cubes of uniform size suitable for continuous feed processes. Moreover, its "just-in-time" size reduction capability eliminates the requirement for inventory of materials with low shelf life.

The bale processor of the present invention is portable, self-contained, free-standing and does not require any major installation except an electrical power connection. It can be used with any kind of unvulcanized rubber. Softness or density is not a limiting factor. The cutter may be modified to use a high-speed laser cutter or an electrical resistance wire (hot Nichrome wire) cutting under a nitrogen blanket, which does not generate any noise, and minimizes degradation. The bulk slab material is cut in specific cubes of uniform size, which are easy to feed in precise amounts, using "loss-in-weight" type belt feeders. The slab material is cut at the speed demanded by the process and hence does not require storing or dusting. The process can be fully automated to make it an unmanned operation. Since only a small amount of material is cut, there is no waste. It will cut virgin rubber without contamination, and it will not require post-process cleaning.

Some significant advantages to the compounding industry include elimination of pre-mixing of rubber bale using internal mixers which introduce unnecessary thermal history; avoids the use of expensive heat stabilizers; reduces inventory and handling of unfinished goods; formulators can use a wide range of elastomers; the simplified bale reduction process reduces direct labor cost by eliminating two-step processes; increase in capital utilization; and starting capital cost is reduced.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

I claim:

1. Processing apparatus for reducing a bale or slab of feedstock rubber comprising:

a console including a frame having an input end and a delivery end;

a first cutter assembly mounted on the console at a first cutting station disposed between in the input end and the delivery end, the first cutter assembly including a cutting member for performing a cutting operation in a cutting zone;

a feeder platform coupled to the input end of the console for positioning a feedstock bale or slab within the cutting zone;

a pick-up head mounted on the console for picking up a segment cut from the feedstock bale or slab at the first cutting station and transferring the segment to a hold-down station;

a hold-down station including a hold-down table disposed on the console for receiving and immobilizing the segment transferred by the pick-up head; and a second cutting station including a first cutter head mounted for extension and retraction across the hold-down table in parallel with a first axis and a second cutter head mounted for extension and retraction across the hold-down table in a direction parallel with a second axis that is transverse to the first axis.

2. Processing apparatus as set forth in claim 1, wherein the first cutter assembly comprises:

a support frame disposed proximate the cutting zone;

the cutting member mounted for extension and retraction along the support frame;

a double-acting ram mounted on the support frame, the ram including a power actuator shaft coupled to the cutting member for extending and retracting the cutting member through the cutting zone.

3. Processing apparatus as set forth in claim 1, wherein the cutting member comprises a guillotine blade.

4. Processing apparatus as set forth in claim 1, wherein the cutting member comprises a continuous blade band saw.

5. Processing apparatus as set forth in claim 1, wherein the feeder platform comprises:

a movable fence disposed for longitudinal extension and retraction movement along the input end of the feeder platform; and a drive motor coupled to the movable fence for advancing the fence towards the first cutting station.

6. Processing apparatus as set forth in claim 1, wherein:

said pick-up head comprises an array of vacuum suction cups and a first double-acting actuator for extending and retracting the suction cups through a vertical plane; and a guide rail is disposed adjacent the hold-down table and a second double-acting actuator is coupled to the pick-up head for extending and retracting the pick-up head along the guide rail.

7. Processing apparatus as set forth in claim 1, wherein the first cutter head includes an array of cutter blades that are extendable and retractable in parallel with a first axis that extends in a first direction across the hold-down table.

8. Processing apparatus as set forth in claim 1, wherein the second cutter head includes an array of cutter blades that are extendable and retractable across the hold-down table in parallel with a second axis that extends transversely with respect to the first axis.

9. Processing apparatus as set forth in claim 1, including a first double-acting linear actuator coupled to the first cutter head for extending and retracting the first cutter head across the hold-down table along the first axis.

10. Processing apparatus as set forth in claim 1, including a second double-acting linear actuator coupled to the second cutter head for extending and retracting the second cutter head across the hold-down table along the second axis.

11. Processing apparatus as set forth in claim 1, wherein the hold-down table comprises a support panel forming a side boundary of an air suction chamber, the hold-down panel being perforated with openings for admitting ambient air into the suction chamber.

12. Processing apparatus as set forth in claim 1, wherein the hold-down table comprises first and second platform sections, each platform section including a support panel that forms a side boundary of an air suction chamber, each hold-down panel being perforated with openings for admitting ambient air into the air suction chamber.

13. An apparatus for processing a bale or slab of material into reduced feedstock cubes or blocks, comprising:

a loading platform;

means for incrementally advancing the bale or slab by a first distance along the loading platform;

means for cutting a segment from the advanced feedstock bale or slab;

a hold-down table;

means for transferring the segment to the hold-down table, wherein the transferring means include a suction cup and a suction source coupled to the suction cup for lifting the segment from the loading platform and then releasing the segment onto the hold-down table;

first means for forming multiple slices through the segment along a first axis, thereby reducing the segment to a plurality of elongated strips; and second means for forming multiple slices through the elongated strips along a second axis that extends transversely with respect to the first axis, thereby producing the feedstock cubes or blocks.

* * * * *